US010227805B2

(12) United States Patent
Wright et al.

(10) Patent No.: US 10,227,805 B2
(45) Date of Patent: Mar. 12, 2019

(54) PRE-HUNG BARN DOOR HARDWARE

(71) Applicant: NW Artisan Hardware, Inc., Kaysville, UT (US)

(72) Inventors: Daniel Ward Wright, Kaysville, UT (US); Chase Robert Norton, Kaysville, UT (US); Jacob Michie, Bountiful, UT (US)

(73) Assignee: NW ARTISAN HARDWARE, INC., Kaysville, UT (US)

( * ) Notice: Subject to any disclaimer, the term of this patent is extended or adjusted under 35 U.S.C. 154(b) by 0 days.

(21) Appl. No.: 15/487,434

(22) Filed: Apr. 14, 2017

(65) Prior Publication Data

US 2017/0298671 A1 Oct. 19, 2017

Related U.S. Application Data

(60) Provisional application No. 62/323,929, filed on Apr. 18, 2016.

(51) Int. Cl.
*A47H 15/00* (2006.01)
*E05D 15/06* (2006.01)

(52) U.S. Cl.
CPC .... *E05D 15/0652* (2013.01); *E05Y 2900/132* (2013.01)

(58) Field of Classification Search
CPC ..... E05D 15/0652; E05D 15/0686; E05D 15/0691; E05D 15/063; E05D 15/0626; E05Y 2900/132; E05Y 2900/142; Y10T 16/35; Y10T 16/354; Y10T 16/373; Y10T 16/379
See application file for complete search history.

(56) References Cited

U.S. PATENT DOCUMENTS 244,418 A * 7/1881 Arnold ..... E05D 15/063 16/107
279,898 A * 6/1883 Wilber ..... E05D 15/063 16/106
281,537 A * 7/1883 Mack ..... E05D 15/063 16/106
2,554,294 A * 5/1951 Conroy ..... E05D 15/063 16/105
4,794,206 A * 12/1988 Weinstein ..... H05K 9/0001 16/354
4,905,345 A * 3/1990 Lunenschloss ..... E05D 15/06 16/94 R
5,718,083 A * 2/1998 Dowdell, II ..... E05F 5/003 312/334.46

(Continued)

FOREIGN PATENT DOCUMENTS

JP 2000291324 A * 10/2000

*Primary Examiner* — Chuck Y Mah

(57) ABSTRACT

A pre-hung barn door hardware system is disclosed. The -hung barn door hardware system includes a rail having a plurality of rail holes disposed along a length of the rail; a plurality of spacers each of the plurality of spacers having a spacer hole; a track having a plurality of track holes disposed along the length of the track; a plurality of bolts, each of the plurality of bolts extending through one of the plurality of rail holes, a spacer hole in one of the plurality of spacers, and one of the plurality of track holes; and a plurality of nuts, each one of the plurality of nuts being coupled with a corresponding one of the plurality of bolts.

15 Claims, 5 Drawing Sheets

(56) References Cited

U.S. PATENT DOCUMENTS

| | | | | |
|---|---|---|---|---|
| 6,865,848 | B2 * | 3/2005 | Krimmel | E05D 11/0081 49/409 |
| 9,745,786 | B2 * | 8/2017 | Andren | E05D 15/063 |
| 2014/0250633 | A1 * | 9/2014 | Allen | E05D 15/0652 16/96 R |
| 2017/0298669 | A1 * | 10/2017 | Boring | E05D 15/063 |

* cited by examiner

PRE-HUNG BARN DOOR HARDWARE

SUMMARY

A pre-hung barn door hardware system is disclosed. The pre-hung barn door hardware system includes a rail having a plurality of rail holes disposed along a length of the rail; a plurality of spacers where each of the plurality of spacers having a spacer hole; a track having a plurality of track holes disposed along the length of the track; a plurality of bolts, each of the plurality of bolts extending through one of the plurality of rail holes, a spacer hole in one of the plurality of spacers, and one of the plurality of track holes; and a plurality of nuts, each one of the plurality of nuts being coupled with a corresponding one of the plurality of bolts.

In some embodiments, the rail has a T-shaped cross-section. In some embodiments, each of the plurality of rail holes include a counter sunk portion. In some embodiments, each bolt includes a head portion, wherein the head portion is disposed relative to the track. In some embodiments, the rail comprises wood. In some embodiments, the track comprises metal. In some embodiments, the plurality of spacers comprises metal. In some embodiments, the pre-hung barn door hardware system includes a stopper coupled with an end of the track.

In some embodiments, the rail includes a base portion and an extended portion, wherein the base portion has a cross-sectional area larger than the cross-sectional area of the extended portion. In some embodiments, the plurality of holes extends through the base portion and the extended portion. In some embodiments, the plurality of spacers are coupled to the rail at the extended portion.

Some embodiments include a pre-hung barn door hardware system comprising a T-shaped rail comprising: an extended portion; a base portion having a plurality of base holes disposed along a length of the rail extending through the base portion; and a plurality of rail holes disposed along a length of the rail extending through the base portion and the extended portion. The pre-hung barn door hardware system also includes a track coupled with the T-shaped rail.

In some embodiments, the track comprises a plurality of track holes disposed along the length of the track; wherein the track and the T-shaped rail are coupled together via the plurality of rail hoes and the track holes. In some embodiments, the pre-hung barn door hardware system includes a plurality of spacers disposed between the track and the T-shaped rail. In some embodiments, each of the plurality of spacers has a spacer hole. In some embodiments, the pre-hung barn door hardware system includes a plurality of bolts, each of the plurality of bolts extending through one of the plurality of rail holes, a spacer hole in one of the spacers, and one of the plurality of track holes; and a plurality of nuts, each one of the plurality of nuts being coupled with a corresponding one of the plurality of bolts.

These illustrative embodiments are mentioned not to limit or define the disclosure, but to provide examples to aid understanding thereof. Additional embodiments are discussed in the Detailed Description, and further description is provided there. Advantages offered by one or more of the various embodiments may be further understood by examining this specification or by practicing one or more embodiments presented.

BRIEF DESCRIPTION OF THE FIGURES

These and other features, aspects, and advantages of the present disclosure are better understood when the following Detailed Description is read with reference to the accompanying drawings.

DETAILED DESCRIPTION

Some embodiments of invention include pre-hung barn door hardware. In some embodiments, pre-hung barn door hardware may include a rail and a track coupled together with a plurality of bolts and nuts, and with a plurality of spacers. In some embodiments, the rail may be made from wood. In some embodiments, the rail may have T-shaped cross-section. In some embodiments, the rail may include a plurality of holes that pass through the rail, one of the plurality of bolts may extend at least partially through one of the plurality of holes. In some embodiments, a back side of the rail may include a plurality of countersunk holes each of which may be aligned with each of the plurality of holes. In some embodiments, each of the countersunk holes may have a diameter larger than a corresponding one of the plurality of holes.

In some embodiments, the track may be made of metal. In some embodiments, the track may include a plurality of holes, and one of the plurality of bolts may extend at least partially through one of the plurality of holes in the track. In some embodiments, the plurality of holes in the track may be aligned with the plurality of holes in the rail so that one of the plurality of bolts may extend through one of the plurality of holes in the rail and through one of the plurality of holes in the track. In some embodiments, the track and the rail may be separated by the plurality of spacers that also have hole passing there through which a bolt may pass.

In some embodiments, the pre-hung barn door hardware may be installed in an architectural space by screwing the rail to the wall. This embodiment, for example, may allow for the track to be installed simply and easily; and allow for a barn door to open and close by rolling a wheel along the track.

Figure 1:
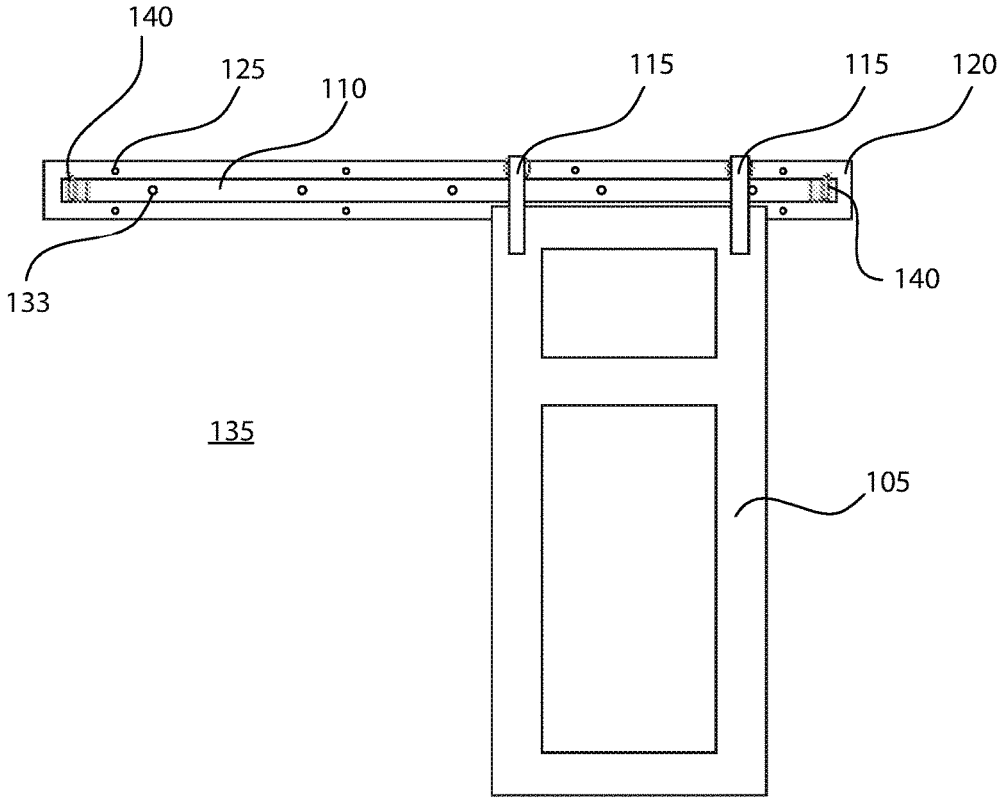
FIG. 1 illustrates a barn door using pre-hung barn door hardware according to some embodiments.

FIG. 1 illustrates a barn door 105 that is installed in an architectural space using pre-hung barn door hardware according to some embodiments. In some embodiments, the pre-hung barn door hardware may include a rail 120, a track 110, and a plurality of spacers 130. The rail 120, the track 110, and the plurality of spacers 130 may be coupled together with a plurality of bolts, nuts, and/or washers.

The barn door 105 may be suspended from the track 110 via hangers 115. The hangers may include a wheel and/or pulley that roll along the track 110. The barn door 105 may slide horizontally across the track 110. In some embodiments, the track 110, may include one or two stoppers 140 positioned at one or both ends of the track 110.

The pre-hung barn door hardware may be installed on a wall 135 by screwing the rail 120 into the wall 135 using screws 125. In some embodiments, the rail 120 may include a plurality of holes 126 through which the screws 125 may pass to secure the rail 120 to the wall 135. In some embodiments, the plurality of holes 126 may be placed in a base portion 122 of the rail 120. In some embodiments, the rail 120, the track 110, and/or the spacers 130 may be coupled together with a plurality of bolts.

Figure 2:
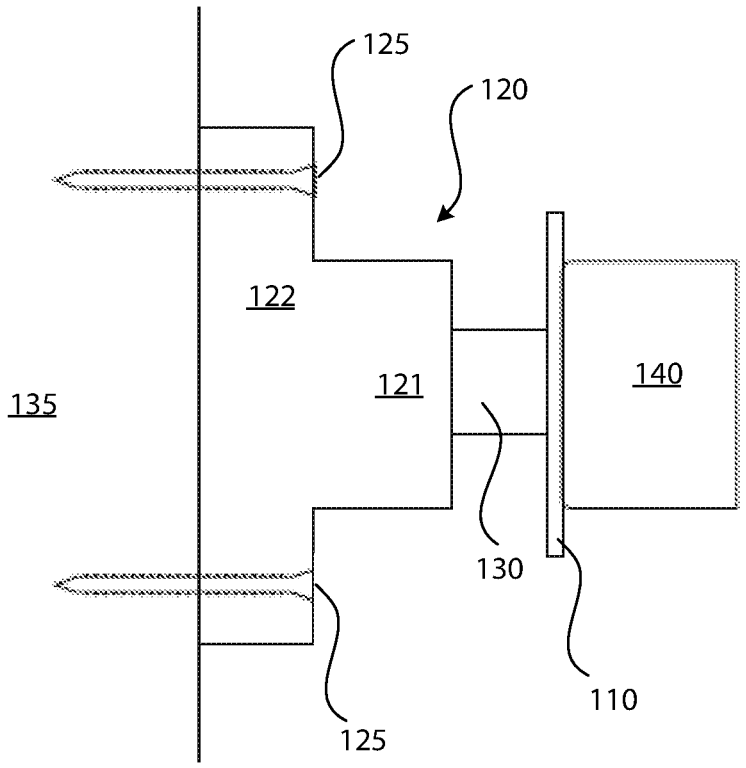
FIG. 2 is a side view of pre-hung hard barn door hardware according to some embodiments.

FIG. 2 is a side view of pre-hung hard barn door hardware. As shown in the figure, in this example, the rail 120 has a T-shaped cross-section. The rail 120 includes a base portion 122 and an extended portion 121 that extends from the base portion 122. The base portion 122 may have a height that is greater than the height of the extended portion 121. The base portion 122 of the rail 120 may be secured to a wall (e.g., wall 135), for example, by screwing the base portion 122 to the wall with screws 125. One or more spacers 130 may be coupled to the extended portion 121 of the rail 120. The track 110 may be coupled with the rail 120 with the spacer 130 in between.

In some embodiments, the spacers 130 may have a cylindrical shape with a hole passing through the longitudinal length of the spacer 130. In some embodiments, the spacer 130 may comprise metal.

The base portion 122 of the rail 120 may have a width (vertical in the figure), for example, of about 4.0", 4.25", 4.5", 4.75", 5.0", 5.25", 5.5", 5.75", 6.0", etc. The extended portion 121 of the rail 120 may have a width (vertical in the figure), for example, of about 1.0", 1.25", 1.5", 1.75", 2.0", 2.25", 2.5", 2.75", 3.0", etc. The base portion 122 of the rail 120 may have a height (horizontal in the figure), for example, of about 0.25", 0.5", 0.75", 1.0", etc. The extended portion 121 of the rail 120 may have a height (horizontal in the figure) that extends, for example, about 0.25", 0.5", 0.75", 1.0", 1.25", 1.5", 1.75", 2.0", etc. from the base portion 122 of the rail 120.

Figure 3:
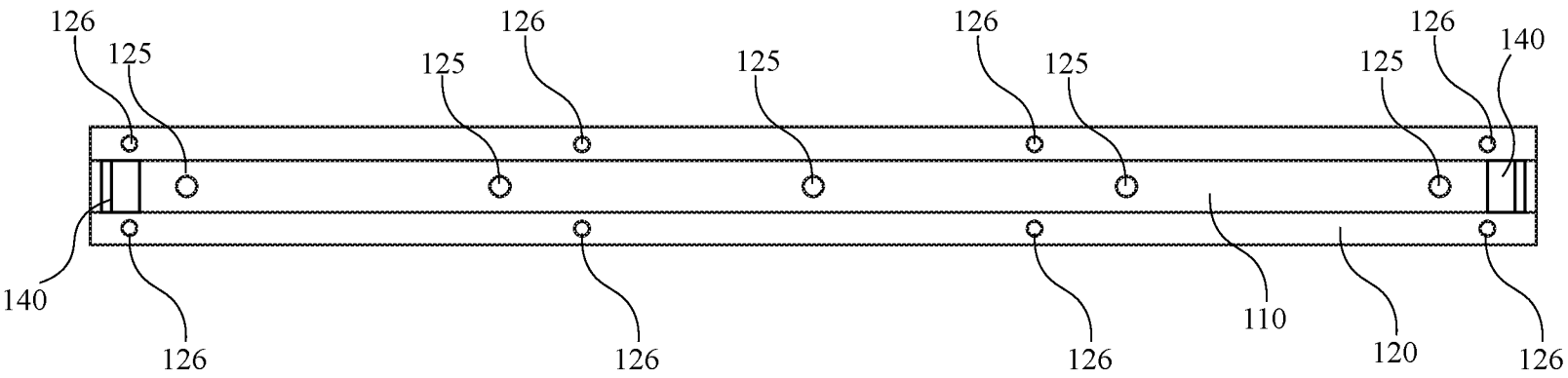
FIG. 3 is a front view of pre-hung door hardware according to some embodiments.

FIG. 3 is a front view of pre-hung door hardware. The track 110 may be coupled with the rail 120. The rail 120 may be secured to the wall via screws 125 that pass through holes 126 in the base portion 122 of the rail 120. The rail 120 and the track 110 may be coupled together via bolts 133 that extend through holes in the track, spacers, and the rail. Stoppers 140 may be coupled with either or both ends of the track 110.

In some embodiments, the holes 126 may be spaced 12", 16", 20", 24", 28", 32", etc. from each other along the length of the rail 120.

Figure 4:
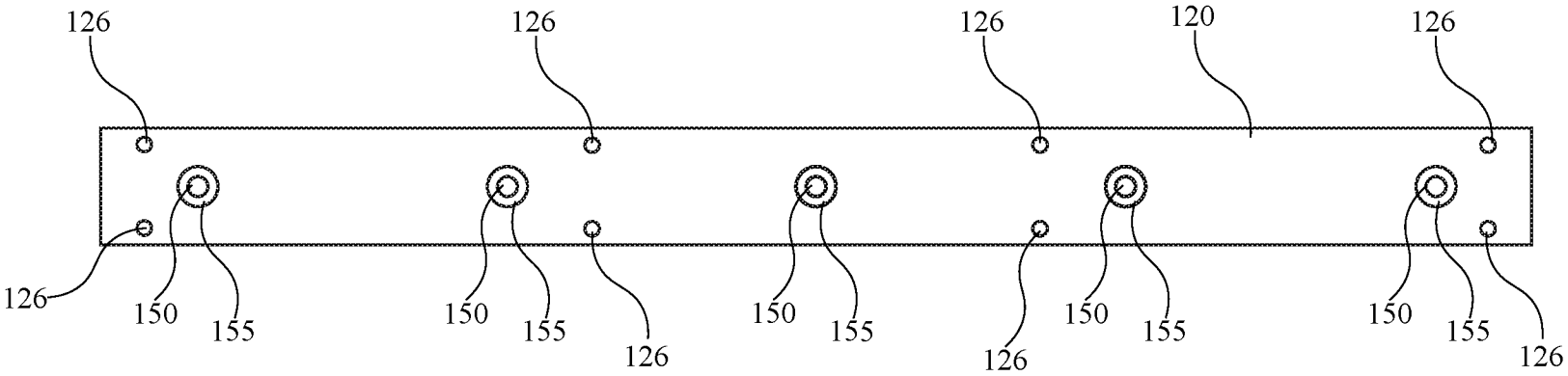
FIG. 4 is a rear view of a rail according to some embodiments.

FIG. 4 illustrates a rear view of the rail 120. The rail 120 may include a plurality of holes 150 that include a countersunk portion 155. The plurality of holes 150 may extend through the rail 120. The countersunk portion 155 of the holes may be a portion of the hole that has a larger diameter and extends a portion of the way through the rail 120 such as, for example, 0.5, 0.75, 1.0, 1.25, 1.5, etc. inches. In some embodiments, the diameter of the countersunk portion 155 of a hole 150 may be larger than the diameter of the hoe. In some embodiments, the countersunk portion 155 may have a diameter large enough so that a bolt and/or a washer (e.g., a lock washer) may be coupled with a bolt that passes through the hole 150.

Figure 5:
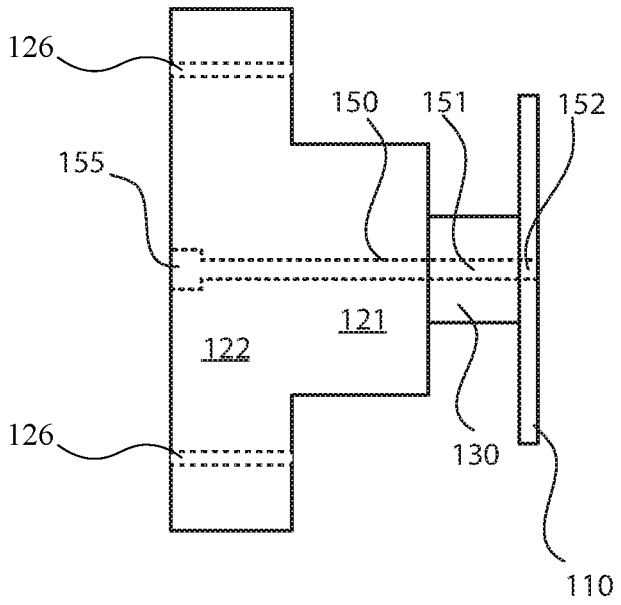
FIG. 5 is side view a of a pre-hung barn door hardware system according to some embodiments.

FIG. 5 is another side view a of a pre-hung barn door hardware system. As shown in the figure, the 150 extends through the rail 120. The countersunk portion 155 of the hole 150 extends only a portion of the way through the rail 120. The spacer 130 also includes a hole 151 that extends through the length of the spacer 130. And the track 110 also includes a hole 152 that extends through the track 110. In some embodiments, the hole 150, the hole 151, and the hole 152 may be aligned symmetrically. In some embodiments, a bolt may extend through the hole 150, the hole 151, and the hole 152. In some embodiments, a nut and/or a lock washer may be coupled with the bolt within the countersunk portion 155.

The term "substantially" means within 5% or 10% of the value referred to or within manufacturing tolerances.

Various embodiments are disclosed. The various embodiments may be partially or completely combined to produce other embodiments.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Some portions are presented in terms of algorithms or symbolic representations of operations on data bits or binary digital signals stored within a computing system memory, such as a computer memory. These algorithmic descriptions or representations are examples of techniques used by those of ordinary skill in the data processing art to convey the substance of their work to others skilled in the art. An algorithm is a self-consistent sequence of operations or similar processing leading to a desired result. In this context, operations or processing involves physical manipulation of physical quantities. Typically, although not necessarily, such quantities may take the form of electrical or magnetic signals capable of being stored, transferred, combined, compared, or otherwise manipulated. It has proven convenient at times, principally for reasons of common usage, to refer to such signals as bits, data, values, elements, symbols, characters, terms, numbers, numerals, or the like. It should be understood, however, that all of these and similar terms are to be associated with appropriate physical quantities and are merely convenient labels. Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical, electronic, or magnetic quantities within memories, registers, or other information storage devices, transmission devices, or display devices of the computing platform.

The system or systems discussed herein are not limited to any particular hardware architecture or configuration. A computing device can include any suitable arrangement of components that provides a result conditioned on one or more inputs. Suitable computing devices include multipurpose microprocessor-based computer systems accessing stored software that programs or configures the computing system from a general-purpose computing apparatus to a specialized computing apparatus implementing one or more embodiments of the present subject matter. Any suitable programming, scripting, or other type of language or combinations of languages may be used to implement the teachings contained herein in software to be used in programming or configuring a computing device.

Embodiments of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for-purposes of example rather than limitation, and does not preclude inclusion of such modifications, variations, and/or additions to the present subject matter as would be readily apparent to one of ordinary skill in the art.

Numerous specific details are set forth herein to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

That which is claimed:

1. A pre-hung barn door hardware system comprising:

a rail having a T-shaped cross section comprising a base and an extended portion, and having a plurality of rail holes disposed along a length of the rail and extending through both the base and the extended portion, the base having an upper portion and a lower portion;

a plurality of mounting holes a first portion of the plurality of mounting holes extending through the bottom portion of the rail and a second portion of the plurality of mounting holes extending through the upper portion of the rail;

a plurality of spacers each of the plurality of spacers having a spacer hole;

a track having a plurality of track holes disposed along the length of the track;

a plurality of bolts, each of the plurality of bolts extending through one of the plurality of rail holes, a spacer hole in one of the plurality of spacers, and one of the plurality of track holes; and a plurality of nuts, each one of the plurality of nuts being coupled with a corresponding one of the plurality of bolts.

2. The system according to claim 1, wherein each of the plurality of rail holes include a counter sunk portion in the base portion.

3. The system according to claim 1, wherein each bolt includes a head portion, wherein the head portion is disposed relative to the track.

4. The system according to claim 1, wherein the rail comprises wood.

5. The system according to claim 1, wherein the track comprises metal.

6. The system according to claim 1, wherein the plurality of spacers comprises metal.

7. The system according to claim 1, further comprising a stopper coupled with an end of the track.

8. The system according to claim 1, wherein the base portion has a cross-sectional area larger than the cross-sectional area of the extended portion.

9. The system according to claim 8, wherein the plurality of holes extends through the base portion and the extended portion.

10. The system according to claim 8, wherein the plurality of spacers are coupled to the rail at the extended portion.

11. A pre-hung barn door hardware system comprising:

a T-shaped rail comprising:

an extended portion;

a base having an upper portion and a lower portion with a first plurality of base holes disposed along a length of the rail extending through the upper portion and a second plurality of base holes disposed along the length of the rail extending through the lower portion, the extended portion extending from the base between the first plurality of base holes and the second plurality of base holes;

a plurality of rail holes disposed along a length of the rail extending through the base and the extended portion;

a track coupled with the T-shaped rail.

12. The system according to claim 11, wherein the track comprises a plurality of track holes disposed along the length of the track; wherein the track and the T-shaped rail are coupled together via the plurality of rail hoes and the track holes.

13. The system according to claim 12, further comprising a plurality of spacers disposed between the track and the T-shaped rail.

14. The system according to claim 13, wherein each of the plurality of spacers has a spacer hole.

15. The system according to claim 14, further comprising a plurality of bolts, each of the plurality of bolts extending through one of the plurality of rail holes, a spacer hole in one of the spacers, and one of the plurality of track holes; and a plurality of nuts, each one of the plurality of nuts being coupled with a corresponding one of the plurality of bolts.

* * * * *